US010295950B2

(12) United States Patent
Iwakawa et al.

(10) Patent No.: US 10,295,950 B2
(45) Date of Patent: May 21, 2019

(54) CLEANING DEVICE AND IMAGE FORMING APPARATUS

(71) Applicant: CANON KABUSHIKI KAISHA, Tokyo (JP)

(72) Inventors: Tadashi Iwakawa, Tokyo (JP); Masato Yuasa, Kashiwa (JP); Keita Shigihara, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/114,398

(22) Filed: Aug. 28, 2018

(65) Prior Publication Data

US 2018/0364634 A1 Dec. 20, 2018

Related U.S. Application Data

(63) Continuation of application No. PCT/JP2017/013498, filed on Mar. 24, 2017.

(30) Foreign Application Priority Data

Mar. 25, 2016 (JP) ..... 2016-062836

(51) Int. Cl.
*G03G 15/00* (2006.01)
*G03G 15/16* (2006.01)
(Continued)

(52) U.S. Cl.
CPC ..... *G03G 21/0029* (2013.01); *G03G 15/16* (2013.01); *G03G 15/168* (2013.01);
(Continued)

(58) Field of Classification Search
CPC ..... G03G 15/168; G03G 21/0005; G03G 21/105; G03G 21/12; G03G 21/0058;
(Continued)

(56) References Cited

U.S. PATENT DOCUMENTS 8,036,586 B2 10/2011 Ichikawa et al.
9,244,422 B2 1/2016 Tsuji
(Continued)

FOREIGN PATENT DOCUMENTS

JP H03-160487 A 7/1991
JP H07-168492 A 7/1995
(Continued)

OTHER PUBLICATIONS

Search Report dated May 16, 2017, in International Application No. PCT/JP2017/013498.

*Primary Examiner* — Sophia S Chen
(74) *Attorney, Agent, or Firm* — Venable LLP

(57) ABSTRACT

A cleaning device includes a cleaning member, a container, a feeding screw including a blade for feeding toner inside the container toward an outside of the container, and a loosening member, stretching along a rotation axis direction of the feeding screw, for loosening toner on a container wall surface provided around the feeding screw by being swung about a rotational axis along the rotation axis direction in a direction crossing the rotation axis direction, and the loosening member includes a contact portion for rotating the loosening member in a first direction with rotation of the feeding screw in contact with the blade when the feeding screw is in a predetermined phase range and includes an urging portion for imparting, to the loosening member, a force for rotating the loosening member in a second direction opposite to the first direction.

11 Claims, 7 Drawing Sheets

(51) Int. Cl.

| | |
|---|---|
| ***G03G 21/00*** | (2006.01) |
| ***G03G 21/10*** | (2006.01) |
| ***G03G 21/12*** | (2006.01) |
| ***G03G 21/16*** | (2006.01) |

(52) U.S. Cl.

CPC ..... *G03G 21/00* (2013.01); *G03G 21/10* (2013.01); *G03G 21/105* (2013.01); *G03G 21/12* (2013.01); *G03G 21/1647* (2013.01); *G03G 21/0058* (2013.01); *G03G 2221/0005* (2013.01)

(58) Field of Classification Search

CPC ..... G03G 21/0076; G03G 2215/1647; G03G 2215/1661; G03G 2221/0005; G03G 2221/001; G03G 15/16; G03G 21/00; G03G 21/10; G03G 21/0029; G03G 21/1647

See application file for complete search history.

(56) References Cited

U.S. PATENT DOCUMENTS

| | | | | |
|---|---|---|---|---|
| 2002/0131799 | A1* | 9/2002 | Kubo ..... | G03G 21/105 399/350 |
| 2015/0063887 | A1* | 3/2015 | Asaoka ..... | G03G 21/105 399/353 |
| 2016/0342129 | A1* | 11/2016 | Matsumoto ..... | G03G 21/105 |
| 2017/0293249 | A1* | 10/2017 | Okura ..... | G03G 21/105 |

FOREIGN PATENT DOCUMENTS

| | | | |
|---|---|---|---|
| JP | H10-293459 | A | 11/1998 |
| JP | 2008-134279 | A | 6/2008 |
| JP | 2008-224726 | A | 9/2008 |
| JP | 2008-268800 | A | 11/2008 |
| JP | 2010-175863 | A | 8/2010 |
| JP | 2010-224313 | A | 10/2010 |
| JP | 2015-225151 | A | 12/2015 |

* cited by examiner (a)

(b)

< FIRST POSITION >

< THIRD POSITION >

< SECOND POSITION >

CLEANING DEVICE AND IMAGE FORMING APPARATUS

TECHNICAL FIELD

The present invention relates to a cleaning device for use with an image forming apparatus and the like, using an electrophotographic type or an electrostatic recording type, and relates to the image forming apparatus.

BACKGROUND ART

In the image forming apparatus using the electrophotographic type or the electrostatic recording type, a toner image formed on an image bearing member by an appropriate process has been transferred onto a toner image receiving material. Toner (transfer residual toner) remaining on the image bearing member after a transfer step is collected by being removed from on the image bearing member by a cleaning means. As the cleaning means, a cleaning device including a cleaning blade as a cleaning member provided in contact with the image bearing member and a cleaning container for supporting the cleaning blade has been used in many cases. This cleaning device scrapes off the transfer residual toner of the moving image bearing member and collects the toner in the cleaning container by the cleaning blade. The transfer residual toner collected in the cleaning container is fed to an outside of the cleaning container by a feeding screw as a feeding means provided in the cleaning container. The transfer residual toner discharged from the cleaning container is sent to a waste toner box.

In such a cleaning device, there is a problem that the toner is deposited and accumulated on a wall surface of the cleaning container around the feeding screw and it becomes difficult to discharge the toner to the outside of the cleaning container. Particularly, the toner after cleaning such that the toner is collected from the image bearing member after being subjected to an image forming process is poor in flowability and is liable to accumulate.

Against such a problem, in Japanese Laid-Open Patent Application Hei 7-168492, a constitution in which an electrode is in the neighborhood of a feeding screw and renders the toner difficult to deposit on a wall surface of a cleaning container by applying a voltage of an opposite polarity to the polarity of the toner to the electrode and thus accumulation of the toner is alleviated has been proposed.

Further, in Japanese Laid-Open Patent Application 2008-224726, as a constitution for loosening (collapsing) toner accumulated in the neighborhood of a feeding screw, a constitution for loosening the toner deposited on the feeding screw by a needle-like stirring member which repeats a rotational operation by rotation and a self-weight of the feeding screw has been proposed.

However, in the constitution of Japanese Laid-Open Patent Application Hei 7-168492, a cost is remarkably increased by providing the electrode. Further, a potential of the toner collected in a cleaning device is not necessarily either one polarity of positive or negative, but in general, the toner having both the polarities is collected even in a small amount. Even if deposition, onto the wall surface, of most toner charged to either of the positive or negative polarity can be suppressed, even in a small amount, the opposite-polarity toner is rather liable to deposit on the wall surface. It would be also considered that voltages of both polarities are applied to the electrode in an appropriate proportion in a switching manner, but it is difficult to control a proportion of polarities of potentials of the toner collected in the cleaning device, and therefore, it is difficult to set the proportion of the positive and negative polarities. Further, when such a constitution is employed, the cost further increases.

Further, in the constitution of Japanese Laid-Open Patent Application 2008-224726, the stirring member is rotationally operated so as to sink between pitches of the feeding screw by its own weight, but under only its own weight, it is difficult to cause the stirring member to perform a desired rotational operation while loosening the accumulated toner. Particularly, loosening of the toner accumulated on the wall surface of the cleaning container by applying the constitution of Patent Document 2 is difficult because it is difficult to set a self-weight direction of the stirring member at a screw direction so that the toner accumulated on the wall surface is sent toward a screw side.

SUMMARY OF THE INVENTION

According to an aspect of the present invention, there is provided a cleaning device comprising:

- a cleaning member, contacting an image bearing member for bearing a toner image, for removing toner from the image bearing member with movement of the image bearing member;
- a container for temporarily accommodating the toner removed from the image bearing member by the cleaning member;
- a feeding screw, including a helical blade, for feeding the toner inside the container to outside of the container; and
- a loosening member, constituted by a member including a linear spring and provided in a neighborhood of the feeding screw and a wall surface of the container, for loosening the toner on the wall surface of the container,
  - wherein the loosening member includes a torsion coil spring portion, a loosening portion, a contact portion and a portion-to-be-limited,
    - wherein the torsion coil spring portion is formed by winding the loosening member about a shaft member provided on one end side of the container and having a rotational axis substantially parallel to a rotational axis direction of the feeding screw, and wherein at one arm portion connecting to the torsion coil spring portion, the portion-to-be-limited is provided, and at the other arm portion connecting to the torsion coil spring portion, the contact portion and the loosening portion are provided,
    - wherein the loosening portion is provided so as to extend in the rotational axis direction and loosens the toner on the wall surface by being rotated about the rotational axis bi-directionally in a direction crossing the rotational axis,
    - wherein the contact portion is provided between the loosening portion and the torsion coil spring portion with respect to the rotational axis direction and contacts a blade of the feeding screw, and rotates the loosening portion in a first direction around the rotational axis by being rotated in the first direction with rotation of the feeding screw, and
    - wherein the portion-to-be-limited is provided further towards an end portion side of the loosening member than the torsion coil spring portion is and is limited in rotation thereof together with the contact portion in contact with a limiting portion provided inside the container, and wherein a restoring force for rotating the loosening portion in a second direction opposite to the first direction is accumulated in the torsion coil spring portion by limiting the portion-to-be-limited by the limiting portion when the contact portion is rotated in the first direction with rotation of the feeding screw, and when the contact portion overcomes the blade with subsequent rotation of the feeding screw, the loosening portion is rotated in the second direction by the accumulated restoring force.

According to another aspect of the present invention, there is provided an image forming apparatus comprising:

an image bearing member for bearing a toner image;

a cleaning member, contacting the image bearing member, for removing toner from the image bearing member with movement of the image bearing member;

a container for temporarily accommodating the toner removed from the image bearing member by the cleaning member;

a feeding screw, including a helical blade, for feeding the toner inside the container to outside of the container; and a loosening member, constituted by a member including a linear spring and provided in a neighborhood of the feeding screw and a wall surface of the container, for loosening the toner on the wall surface of the container, wherein the loosening member includes a torsion coil spring portion, a loosening portion, a contact portion and a portion-to-be-limited, wherein the torsion coil spring portion is formed by winding the loosening member about a shaft member provided on one end side of the container and having a rotational axis substantially parallel to a rotational axis direction of the feeding screw, and wherein at one arm portion connecting to the torsion coil spring portion, the portion-to-be-limited is provided, and at the other arm portion connecting to the torsion coil spring portion, the contact portion and the loosening portion are provided, wherein the loosening portion is provided so as to extend in the rotational axis direction and loosens the toner on the wall surface by being rotated about the rotational axis bi-directionally in a direction crossing the rotational axis, wherein the contact portion is provided between the loosening portion and the torsion coil spring portion with respect to the rotational axis direction and contacts a blade of the feeding screw, and rotates the loosening portion in a first direction around the rotational axis by being rotated in the first direction with rotation of the feeding screw, and wherein the portion-to-be-limited is provided further towards an end portion side of the loosening member than the torsion coil spring portion is and is limited in rotation thereof together with the contact portion in contact with a limiting portion provided inside the container, and wherein a restoring force for rotating the loosening portion in a second direction opposite to the first direction is accumulated in the torsion coil spring portion by limiting the portion-to-be-limited by the limiting portion when the contact portion is rotated in the first direction with rotation of the feeding screw, and when the contact portion overcomes the blade with subsequent rotation of the feeding screw, the loosening portion is rotated in the second direction by the accumulated restoring force.

EMBODIMENTS FOR CARRYING OUT THE INVENTION

In the following, a cleaning device and an image forming apparatus according to the present invention will be further specifically described in accordance with the drawings.

Embodiment 1

1. General Structure and Operation of Image Forming Apparatus

Figure 1:
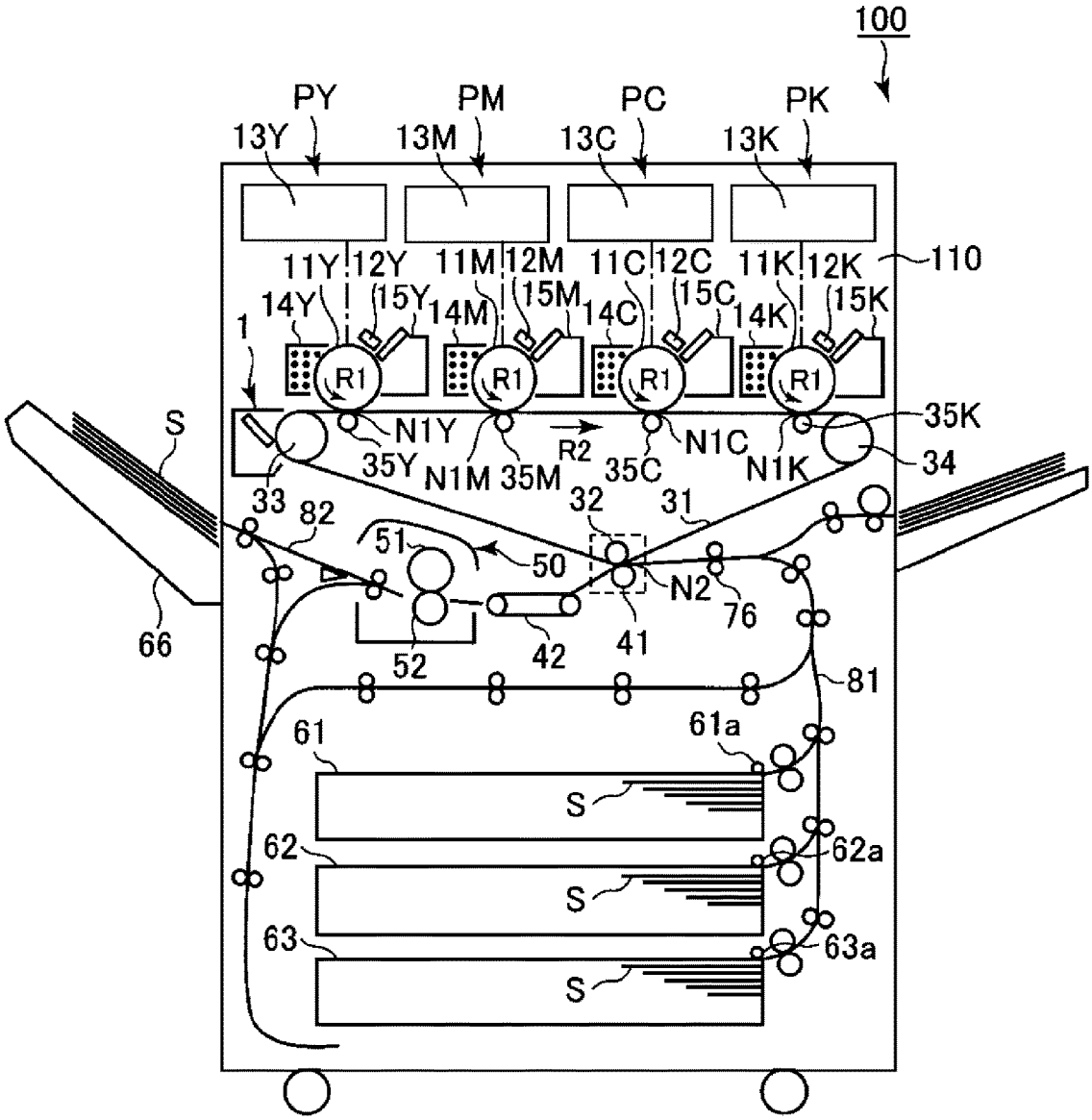
FIG. 1 is a schematic sectional view of an image forming apparatus.

FIG. 1 is a schematic sectional view of an image forming apparatus 100 according to this embodiment. The image forming apparatus 100 in this embodiment is a tandem-type printer which is capable of forming a full-color image by using an electrophotographic type and which employs an intermediary transfer type.

The image forming apparatus 100 includes first, second, third and fourth image forming portions PY, PM, PC and PK as a plurality of image forming portions (stations). The first, second, third and fourth image forming portions PY, PM, PC and PK form images of respective colors of yellow (Y), magenta (M), cyan (C) and black (K), respectively. In this embodiment, structures and operations of the respective image forming portions P are substantially the same except that colors of toners used in a developing step described later are different from each other. Accordingly, in the case where distinction is not particularly required, suffixes Y, M, C and K representing elements for associated colors are omitted, and the associated elements will be collectively described. In this embodiment, the image forming portion P is constituted by a photosensitive drum 11, a charger 12, an exposure device 13, a developing device 14, a primary transfer roller 35, a drum cleaning device 15 and the like which are described later.

The photosensitive drum 11, as a first image bearing member, which is a drum-shaped (cylindrical) photosensitive member (electrophotographic photosensitive member) is rotationally driven in an arrow R1 direction (counterdirectionally) in the figure. A surface of the rotating photosensitive drum 11 is electrically charged uniformly to a predetermined polarity (negative polarity in this embodiment) and a predetermined potential by the charger 12, as a charging means. The charged surface of the photosensitive drum 11 is subjected to scanning exposure by the exposure device 13 (laser scanner) depending on an image signal of a component color corresponding to each of the image forming portions. By this, an electrostatic latent image (electrostatic image) is formed on the photosensitive drum 11. The electrostatic latent image formed on the photosensitive drum 11 is supplied with toner as a developer by the developing device 14 as a developing means, and is developed (visualized) as a toner image. In this embodiment, on an exposed portion of the photosensitive drum 11 lowered in absolute value of the potential by being exposed to light after being charged uniformly, the toner charged to an identical polarity (negative polarity in this embodiment) to a charge polarity of the photosensitive drum 11 is deposited (reversal development).

An intermediary transfer belt 31, as a second image bearing member, which is an intermediary transfer member constituted by an endless belt is provided so as to oppose the respective photosensitive drums 11 of the respective image forming portions P. The intermediary transfer belt 31 is wound around, as a plurality of stretching rollers (supporting members), a driving roller 33, a tension roller 34 and a secondary transfer opposite roller 32, and is stretched under a predetermined tension. The intermediary transfer belt 31 is rotated (circulated and moved) in an arrow R2 direction (clockwisely) in the figure by being driven by the driving roller 33. Inside the intermediary transfer belt 31, the primary transfer rollers 35, as primary transfer means, which are roller-type primary transfer members are disposed correspondingly to the respective photosensitive drums 11. The primary transfer roller 35 is pressed (urged) toward the photosensitive drum 11 via the intermediary transfer belt 31 and forms a primary transfer portion (primary transfer nip) N1 where the photosensitive drum 11 and the intermediary transfer belt 31 are in contact with each other.

The toner image formed on the photosensitive drum 11 as described above is transferred (primary-transferred) onto the intermediary transfer belt 1 at the primary transfer portion N1 under application of predetermined pressure and a predetermined electrostatic load bias. For example, during full-color image formation, the toner images of the respective colors of yellow, magenta, cyan and black formed on the respective photosensitive drums 11 are successively transferred superposedly onto the intermediary transfer belt 31. The toner (primary transfer residual toner) remaining on the photosensitive drum 11 after the primary transfer step is removed and collected from the photosensitive drum 11 by the drum cleaning device 15 as a photosensitive member cleaning means.

On an outer peripheral surface side of the intermediary transfer belt 31, at a position opposing the secondary transfer opposite roller 32, a secondary transfer roller 41, as a secondary transfer means, which is a roller-type secondary transfer member is provided. The secondary transfer roller 41 is pressed (urged) toward the secondary transfer roller 41 via the intermediary transfer belt 31 and forms a secondary transfer portion (secondary transfer nip) N2 which is a contact portion between the intermediary transfer belt 31 and the secondary transfer roller 41.

The toner image formed on the intermediary transfer belt 31 as described above is transferred (secondary-transferred) onto a transfer material S, such as paper fed by being sandwiched between the intermediary transfer belt 31 and the secondary transfer roller 41, at the secondary transfer portion N2 under application of predetermined pressure and a predetermined electrostatic load bias. The transfer materials S are accommodated, for example, in cassettes 61, 62 and 63, and after being sent by pick-up rollers 61*a*, 62*a* and 63*a* or the like, are caused to pass through a feeding path 81 and are fed to a registration roller 76. Then, by the registration roller 76, this transfer material S is timed to the toner image on the intermediary transfer belt 31, and is supplied to the secondary transfer portion N2. The toner (secondary transfer residual toner) remaining on the intermediary transfer belt 31 after the secondary transfer step is removed and collected from the intermediary transfer belt 31 by a belt cleaning device 1 as an intermediary transfer member cleaning means. The belt cleaning device 1 will be described later specifically.

The transfer material S on which the toner image is transferred is fed to a fixing device 50 as a fixing means by a feeding belt 42. The fixing device 50 heats and presses the transfer material S while nipping and feeding the transfer material S by a fixing roller 51 and a pressing roller 52, and fixes (melt-fixes) the toner image on the transfer material S. The transfer material S on which the toner image is fixed passes through a feeding path 82 and is discharged onto a discharge tray 66 provided outside an apparatus main assembly 110 of the image forming apparatus 100.

2. Belt Cleaning Device

Figure 2:
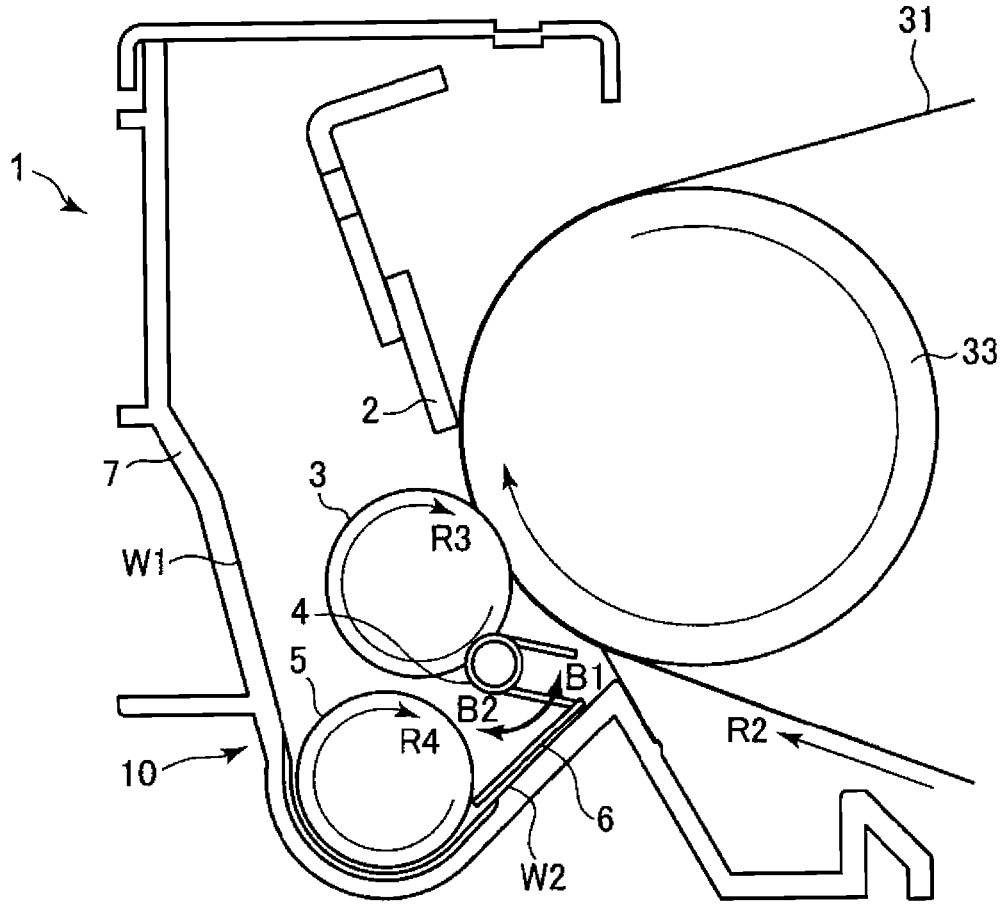
FIG. 2 is a sectional view of a neighborhood of a belt cleaning device.

Next, the belt cleaning device 1 in this embodiment will be described. FIG. 2 is a sectional view of a neighborhood of the belt cleaning device 1.

The belt cleaning device 1 includes a cleaning blade 2 as a first cleaning member, a fur brush 3 as a second cleaning member, a scraper 4, a feeding screw 5, a loosening member 6 and a cleaning container 7.

The cleaning blade 2 is provided downstream of a secondary transfer portion N2 and upstream of the primary transfer portion N1 (the mostupstream primary transfer portion N1Y) with respect to a movement direction of the intermediary transfer belt 31 in contact with the intermediary transfer belt 31. Particularly, in this embodiment, the cleaning blade 2 is pressed toward the driving roller 33 through the intermediary transfer belt 31. The cleaning blade 2 is a plate-like member which has predetermined lengths with respect to a longitudinal direction disposed in a direction substantially perpendicular to the movement direction of the intermediary transfer belt 31 and a widthwise direction substantially perpendicular to the longitudinal direction, respectively, and a predetermined thickness and which is formed of an elastic material (for example, urethane rubber). The cleaning blade 2 is contacted to the intermediary transfer belt 31 so as to extend in a counterdirection against the movement direction of the intermediary transfer belt 31, i.e., so that a free end portion thereof with respect to the widthwise direction is oriented toward an upstream side of the movement direction of the intermediary transfer belt 31.

The fur brush 3 is provided downstream of the secondary transfer portion N2 and upstream of a contact portion between the cleaning blade 2 and the intermediary transfer belt 31 with respect to the movement direction of the intermediary transfer belt 31 in contact with the intermediary transfer belt 31. Particularly, in this embodiment, the fur brush 3 is disposed below the cleaning blade 2 with respect to a direction of gravitation and is pressed toward the driving roller 33 through the intermediary transfer belt 31. The fur brush 3 is a rotatable brush like member in which a plurality of fibers (for example, acrylic fibers) are provided around a rotation shaft provided along a direction substantially perpendicular to the movement direction of the intermediary transfer belt 31. The fur brush 3 is rotated by transmitting thereto a driving force from a driving motor (not shown) as a driving means provided in the apparatus main assembly 110. The fur brush 3 is rotationally driven so as to move in the counter direction against the movement direction of the intermediary transfer belt 31, i.e., in an opposite direction to the movement direction of the intermediary transfer belt 31 at the contact portion with the intermediary transfer belt 31, as shown by an arrow R3 in the figure.

The scraper 4 is disposed in contact with the fur brush 3 on a side downstream of the contact portion between the fur brush 3 and the intermediary transfer belt 31 with respect to a rotational direction of the fur brush 3. The scraper 3 is a bar-like member disposed along a direction substantially perpendicular to the movement direction of the intermediary transfer belt 31. The scraper 4 scrapes off and removes the toner and the like entering among fibers of the fur brush 3.

Figure 4:
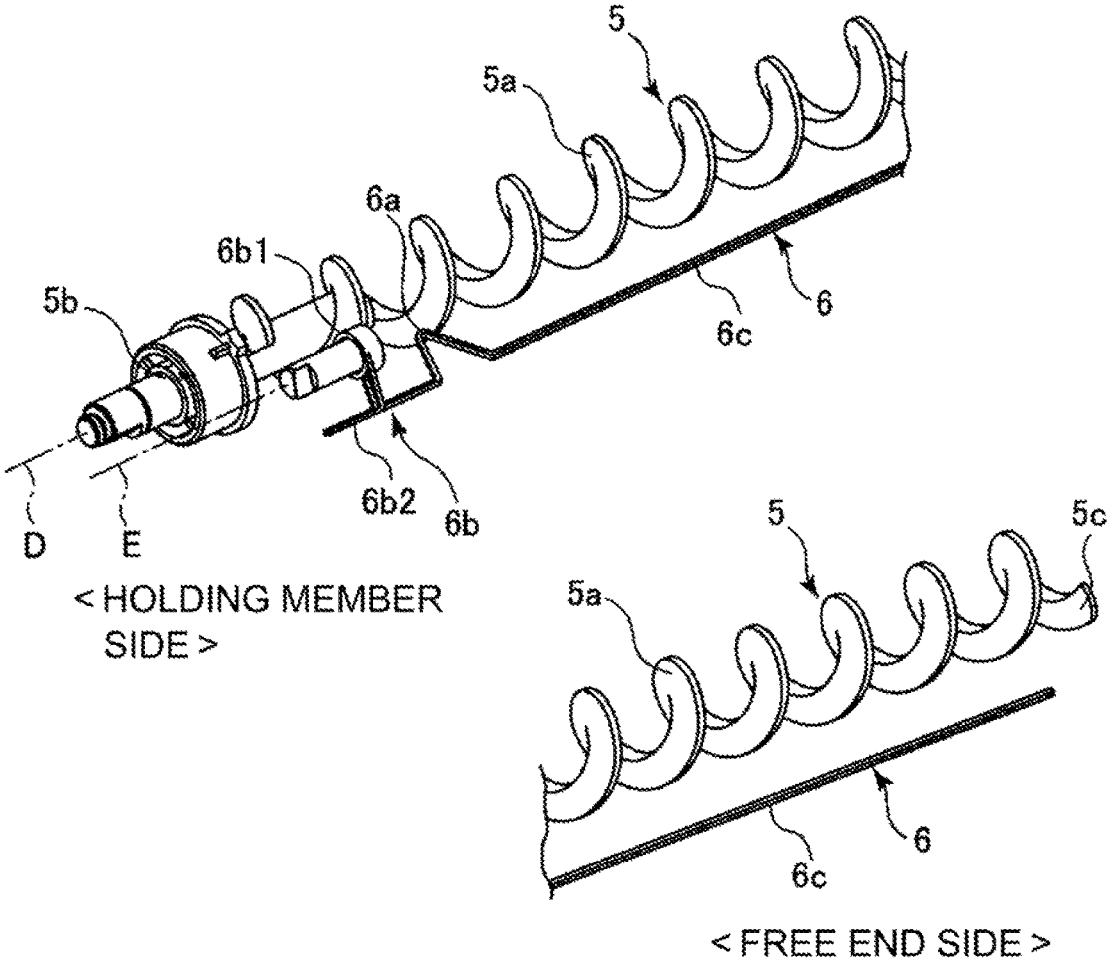
FIG. 4 includes perspective views of a loosening member and a feeding screw.

The feeding screw 5 is disposed below the cleaning blade 2, the fur brush 3 and the scraper 4 with respect to the direction of gravitation in the neighborhood of a bottom of the cleaning container 7. The feeding screw 5 includes a blade (inclined surface of the screw) 5*a* (FIG. 4). The feeding screw 5 is rotated by transmitting thereto a rotational force from a driving motor (not shown) as a driving means provided in the apparatus main assembly 110. The feeding screw 5 feeds the toner and the like, inside the cleaning container 7, scraped off of the surface of the intermediary transfer belt 31 by the cleaning blade 2 and the fur brush 3 toward the outside of the cleaning container 7. In this embodiment, the feeding screw 5 is rotationally driven in the same direction as the rotational direction of the fur brush 3 as shown by an arrow R4 in the figure.

The loosening member 6 loosens the toner accumulated on a wall surface (inner wall) of the cleaning container 7 and feeds the toner toward the feeding screw 5.

The cleaning container 7 supports the cleaning blade 2, the fur brush 3, the scraper 4, the feeding screw 5 and the loosening member 6 and accommodates the toner and the like scraped off of the surface of the intermediary transfer belt 31 by the cleaning blade 2 and the fur brush 3. As described above, the feeding screw 5 is disposed in the neighborhood of the bottom of the cleaning container 7. The wall surface, of the cleaning container 7, provided adjacent to the feeding screw 5 and extending in the direction substantially perpendicular to the movement direction of the intermediary transfer belt 31 is an inclined surface inclined toward below the feeding screw 5. Of the inclined wall surface of the cleaning container 7 adjacent to the feeding screw 5, the wall surface on an opposite side from the intermediary transfer belt 31 with respect to a vertical surface passing through a rotational axis (rotation center) of the feeding screw 5 is a first wall surface W1, and the wall surface on the intermediary transfer belt 31 side is a second wall surface W2. Incidentally, the toner and the like fed by the feeding screw 5 and discharged to the outside of the cleaning container 7 are sent to a waste toner box (not shown) provided to the image forming apparatus 100.

Figure 3:
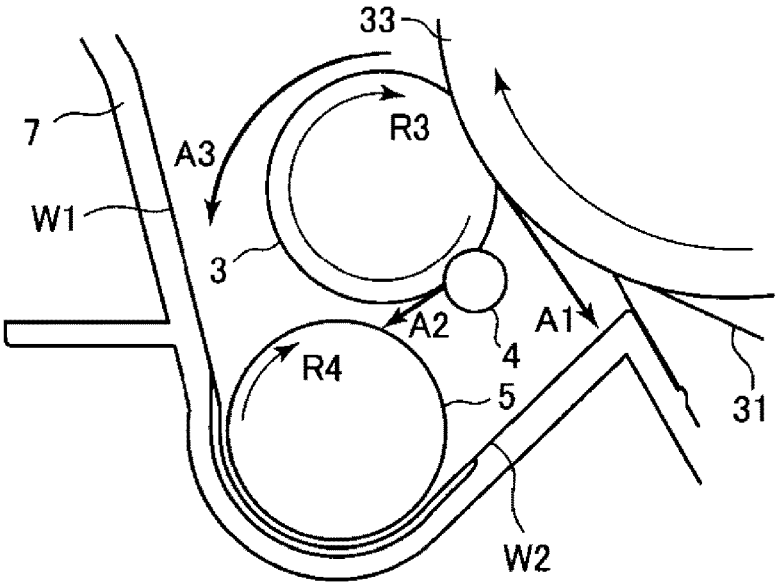
FIG. 3 includes schematic views showing a behavior of toner in the belt cleaning device.
Figure 3:
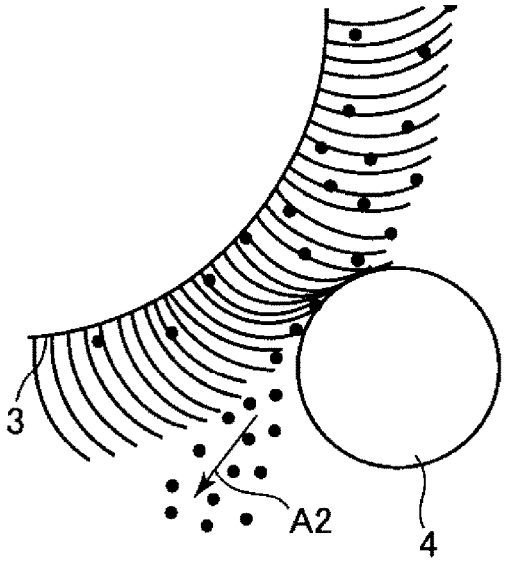

With reference to FIGS. 2 and 3, the action of the belt cleaning device 1 will be further described. FIG. 3 includes sectional views showing a behavior of the toner and the like in the cleaning container 7 during a cleaning operation.

Toner (transfer residual toner) remaining on the intermediary transfer belt 31 after the secondary transfer step is sent to a cleaning portion where the intermediary transfer belt 31 is cleaned by the belt cleaning device. At this time, not only the transfer residual toner but also a deposited matter (herein also simply referred to as a "foreign matter"), other than the toner, such as minute foreign matter and paper powder which were placed on the transfer material S are sent to the cleaning portion where the intermediary transfer belt 31 is cleaned by the belt cleaning device. The cleaning blade 2 is formed of a rubber such as urethane rubber, for example, in many cases. For that reason, when the foreign matter is sent to a contact portion (herein also referred to as a "blade nip") between the cleaning blade 2 and the intermediary transfer belt 31, there is a liability that the foreign matter is nipped in the blade nip and improper cleaning (cleaning failure) is caused to occur. Therefore, the fur brush 3 is provided for removing such a foreign matter from on the intermediary transfer belt 31 on a side upstream of the blade nip.

The fur brush 3 rotates in a counterdirection to the movement direction of the intermediary transfer belt 31 and knocks a part of the transfer residual toner and the foreign matter on the intermediary transfer belt 31 off on the intermediary transfer belt 31. Thereafter, the transfer residual toner, on the intermediary transfer belt 31, which was not completely removed even by the fur brush 3 is scraped off by the cleaning blade 2. The toner scraped off by the cleaning blade 2 drops onto the fur brush 3 positioned below the cleaning blade 2 with respect to the direction of gravitation. Then, a part of the toner enters among the fibers of the fur brush 3, and remaining toner freely drops onto the feeding screw 5 from a gap on a side with respect to an opposite direction to the rotational direction of the fur brush 3 as shown by an arrow A3 of FIG. 3(*a*).

The toner scraped off by the cleaning blade 2 and entered among the fibers of the fur brush 3 and a part of the transfer residual toner on the intermediary transfer belt exhibit the following behavior. That is, as shown in FIG. 3(*a*), by an operation in which the fibers of the fur brush 3 entered the intermediary transfer belt 31 are deformed and raised, the toner is flocked toward the second wall surface W2 of the cleaning container 7 in an arrow A1 direction in the figure. Further, the toner which is not flicked by the above-described fiber raising operation and which entered among the fibers of the fur brush 3 exhibits the following behavior. That is, by an operation in which the fibers of the fur brush 3 deformed by the scraper 4 disposed by entering the fur brush 3 are raised, the toner is flicked toward the feeding screw 5 in an arrow A2 direction in the figure. At this time, in general, as shown in FIG. 3(*b*), the toner is flicked in a tangential direction of a contact portion between the fur brush 3 and the scraper 4.

Incidentally, in this embodiment, longitudinal lengths of the cleaning blade 2, the fur brush 3, the scraper 4 and the feeding screw 5 are longer than a length of an image forming region on the intermediary transfer belt 31 with respect to the direction substantially perpendicular to the movement direction of the intermediary transfer belt 31. That is, with respect to the direction substantially perpendicular to the movement direction of the intermediary transfer belt 31, a range of the length of the image forming region on the intermediary transfer belt 31 falls within the lengths of the above-described respective members. The length of the image forming region on the intermediary transfer belt 31 with respect to the direction substantially perpendicular to the movement direction of the intermediary transfer belt 31 refers to a maximum length in a region, on the intermediary transfer belt 31 with respect to the direction, in which the toner image is formable. Further, herein, the direction (widthwise direction) substantially perpendicular to the movement direction of the intermediary transfer belt 31 is also referred to as a "thrust direction".

Here, in order to suppress accumulation of the toner on the wall surface around the feeding screw in the cleaning container by deposition of the toner on the wall surface, the following constitution is desirable. That is, it is desirable that the feeding screw is disposed immediately below and in the neighborhood of the blade nip with respect to the direction of gravitation and that angles of the wall surfaces on both sides of the feeding screw are sufficiently larger than an angle of repose of the toner after the cleaning. However, depending on a relationship with another constituent component and the like, it is difficult in some cases that the feeding screw is disposed immediately below and in the neighborhood of the blade nip with respect to the direction of gravitation. Further, in the case where in addition to the cleaning blade, the fur brush is disposed, the toner is discharged toward the feeding screw from a plurality of portions including the cleaning blade and the fur brush. It is difficult in some cases that the feeding screw is disposed immediately below and in the neighborhood of each of the plurality of toner discharging portions with respect to the direction of gravitation. Incidentally, the angle of repose refers to an angle of an inclined surface with respect to a horizontal plate when the toner naturally starts to break in the case where the toner is heaped up on the horizontal plate. The angle of repose can be measured using a commercially available measuring device, and can be represented by an average value in a representative use (operation) environment (for example, a temperature of 23° C., a humidity of 60% RH).

In this embodiment, the arrangement of the feeding screw 5 is brought near to a position immediately below the blade nip to the extent possible with respect to the direction of gravitation but not immediately below the blade nip. Further, in this embodiment, a wall surface angle (an angle formed with a horizontal surface in a use state) of the first wall surface on a left side of the feeding screw 5 in FIG. 2 is 80 degrees, a wall surface angle of the second wall surface on a right side in FIG. 2 is 40 degrees, and the angle of repose of the transfer residual toner is 45 degrees. The wall surface angle of the first wall surface W1 is sufficiently larger than the angle of repose of the transfer residual toner, and therefore, the transfer residual toner does not accumulate on the first wall surface W1. However, the wall surface angle of the second wall surface W2 is not more than equal to the angle of repose of the transfer residual toner, and therefore, the transfer residual toner is liable to accumulate on the second wall surface W2.

Therefore, in this embodiment, the belt cleaning device 1 is provided with the loosening member 6 for feeding the toner accumulated on the second wall surface W2 toward the feeding screw 5 by loosening the toner. That is, of the wall surfaces provided around the feeding screw 5 on both sides of the vertical surface passing through the rotational axis of the feeding screw 5, the first wall surface W1 has the wall surface angle larger than the angle of repose of the toner in the container, and the second wall surface W2 has the wall surface angle smaller than the wall surface angle of the first wall surface W1. Further, the loosening member 6 is provided so as to loosen the toner on the second wall surface, relatively smaller in wall surface angle, of the first and second wall surfaces W1 and W2. Particularly, in this embodiment, the wall surface angle of the second wall surface W2 is smaller than the angle of repose of the toner in the container.

In this embodiment, a toner feeding device 10 is constituted by the feeding screw 5, the loosening member 6, the cleaning container 7 and the like.

3. Loosening Member

Next, with reference to FIGS. 4 and 5, a structure and an operation of the loosening member 6 will be described. FIG. 4 includes perspective views of the feeding screw 5 and the loosening member 6, and the feeding screw 5 is shown in a manner that an end portion side where a holding portion 5*b* described later is provided and a free end portion 5*c* side are separated from each other. Further, FIG. 5 includes sectional views and side views showing the operation of the loosening member 6 with time.

The loosening member 6 stretches along the rotation axis direction of the feeding screw 5 and is provided so as to swing about a rotational axis along (in this embodiment, substantially parallel to) the rotational axis of the feeding screw 5 in a direction crossing (in this embodiment, substantially perpendicular to) the rotational axis of the feeding screw 5. Further, this loosening member 6 is configured to loosen the toner on the wall surface of the cleaning container 7 provided around the feeding screw 5, particularly on the second wall surface W2 in this embodiment. The loosening member 6 includes a contact portion 6*a* for rotating the loosening member 6 in a first direction (an arrow B1 direction in FIG. 5(*a*)) with rotation of the feeding screw 5 in contact with the blade 5*a* of the feeding screw 5 when the feeding screw 5 is in a predetermined phase range. Further, the loosening member 6 includes an urging portion 6*b* for imparting, to the loosening member 6, a force for rotating the loosening member 6 in a second direction (an arrow B2 direction in FIG. 5(*c*)) opposite to the first direction B1. Particularly, in this embodiment, in the loosening member 6, the contact portion 6*a*, the urging portion 6*b* and a loosening portion for loosening the toner are integrally formed with a linear spring material (linear spring). That is, in this embodiment, the loosening member 6 is constituted by a single component part. In the following, description will be made further specifically.

Figure 5:
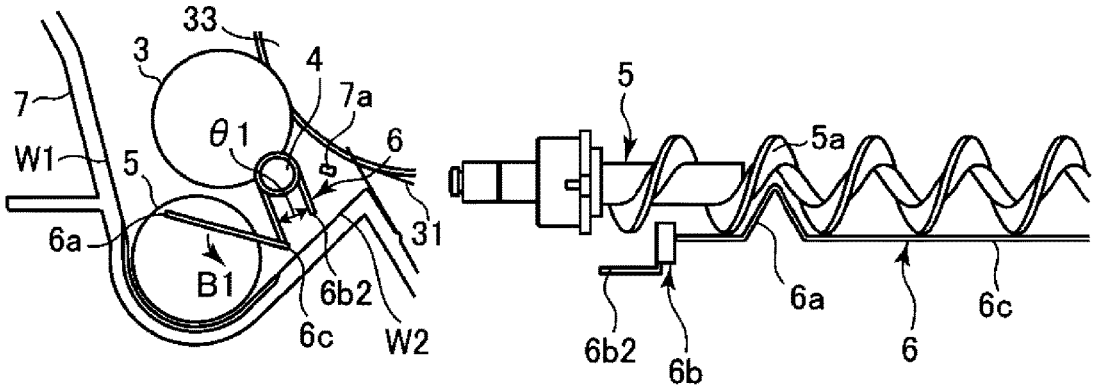
FIG. 5 includes sectional views and side views, of a neighborhood of the loosening member, showing an operation of the loosening member.
Figure 5:
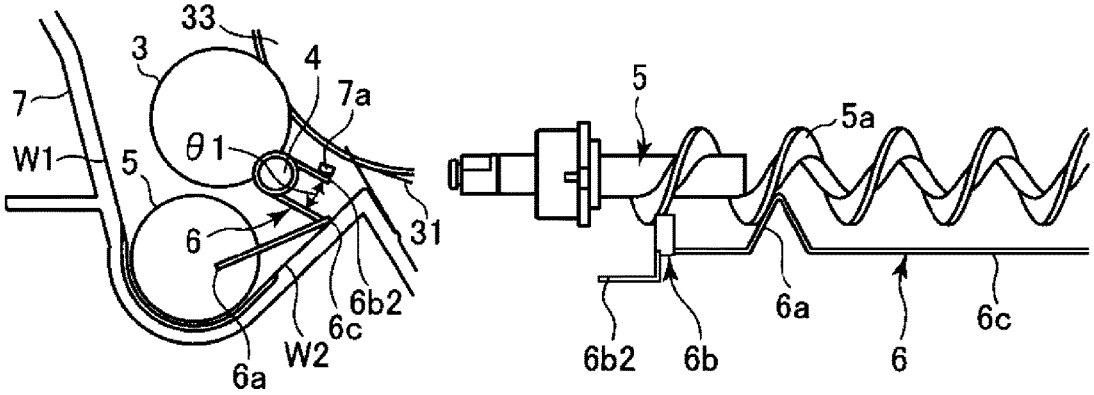
Figure 5:
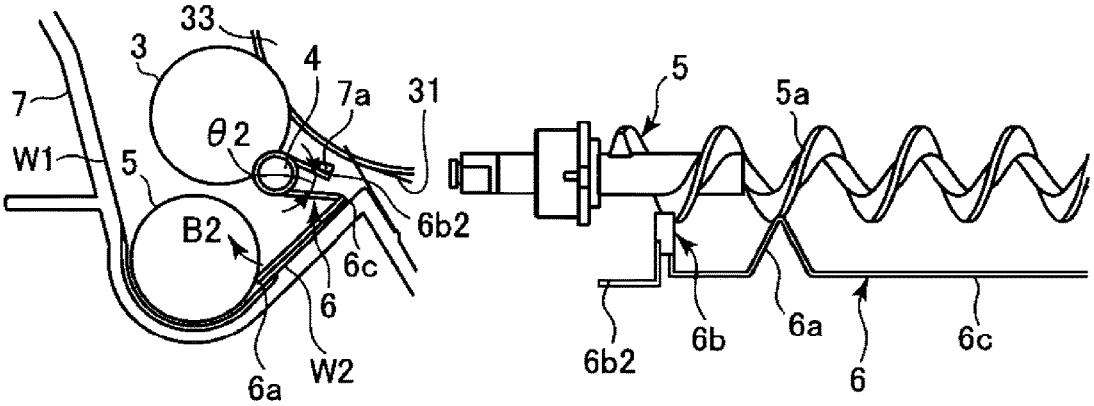

As shown in FIGS. 4 and 5, in this embodiment, the loosening member 6 is formed as a whole with the linear spring stretching along (in this embodiment, substantially parallel to) a rotational axis D of the feeding screw 5.

The loosening member 6 has a torsion coil spring shape at one end portion thereof with respect to a rotational axis E direction, so that the urging portion (torsion coil spring shape portion) 6*b* is constituted. The loosening member 6 is supported rotatably (swingably) through a coil portion 6*b*1 of the urging portion 6*b* so that a center axis of the coil portion 6*b*1 coincides with the rotational axis E of the loosening member 6. In this embodiment, the rotational axis E of the loosening member 6 is coaxial with a center axis of the scraper 4. One arm portion of the urging portion 6*b* is bent so as to stretch toward an extreme end of the loosening member 6 on the urging portion 6*b* side substantially parallel to the rotational axis E and constitutes an engaging portion 6*b*2 engageable with a portion-to-be-engaged 7*a* described later. Further, the other arm portion of the urging portion 6*b* is bent so as to stretch toward an end portion on an opposite side from the urging portion 6*b* of the loosening member 6 substantially parallel to the rotational axis E, so that at a stretched portion thereof, the contact portion 6*a* and the loosening portion 6*c* are formed. That is, a part of the stretched portion is bent so as to project toward the stirring screw 5 side, so that the contact portion 6*a* contactable to the blade 5*a* of the stirring screw 5 is constituted. Further, a portion stretched further substantially parallel to the rotational axis E toward the opposite side from the urging portion 6*b* than this contact portion 6*a* constitutes the loosening portion 6*c* for feeding the toner accumulated on the second wall surface W2 toward the feeding screw 5 by loosening the toner.

Thus, in this embodiment, the loosening portion 6*c* extends in the direction (thrust direction) substantially perpendicular to the movement direction of the intermediary transfer belt 31. In this embodiment, in the thrust direction, a length of the loosening portion 6*c* is longer than the length of the image forming region on the intermediary transfer belt 31. That is, in the thrust direction, a range of the length of the image forming region on the intermediary transfer belt 31 falls within a range of the length of the loosening portion 6*c*. An arrangement of the contact portion 6*a* in the loosening member 6 will be described later further specifically.

The loosening member 6 rotates between a first position (FIG. 5(*a*)) closest to the rotational axis D of the feeding screw 5 and a second position (FIG. 5(*c*)) furthest from the rotational axis D of the feeding screw 5.

When the feeding screw 5 rotates, the blade 5*a* and the contact portion 6*a* contact each other, so that the contact portion 6*a* is pushed by the blade 5*a* and the loosening member 6 is rotated from the first position (FIG. 5(*a*)) toward the second position (FIG. 5(*c*)) in the first direction B1. Further, a restoring force is accumulated in the loosening member 6 by compression of the urging portion 6*b* against an elastic force through engagement of the engaging portion 6*b*2 with a component part other than the feeding screw 5, in this embodiment, with the portion-to-be-engaged 7*a* formed in the cleaning container 7. That is, the urging portion 6*b* deforms so that an angle between the arm portions of the torsion coil spring shape changes from a free angle θ1 at which pressure does not act on the urging portion 6*b* to a twist angle θ2 at which a desired torsion moment torque generates.

At this time, the engaging portion 6*b*2 does not engage with the portion-to-be-engaged 7*a* until the loosening member 6 reaches a third position (FIG. 5(*b*)) located midway during rotation of the loosening member 6 from the first position (FIG. 5(*a*)) toward the second position (FIG. 5(*c*)). During this period, the loosening member 6 rotates in a state that the angle between the arm portions of the urging portion 6*b* is kept at the free angle θ1, and therefore, the torsion moment torque does not generate. When the loosening member 6 reaches the third position (FIG. 5(*b*)), the engaging portion 6*b*2 engages with the portion-to-be-engaged 7*a*. Then, the loosening member 6 rotates to the second position after the engaging portion 6*b*2 engages with the portion-to-be-engaged 7*a* at the third position, so that the urging portion 6*b* imparts, to the loosening member 6, a force for rotating the loosening member 6 in the second direction B2. That is, the loosening member 6 rotates from the third position toward the second position while amplifying the torsion moment torque by decreasing the angle between the arm portions of the urging portion 6*b* from the free angle θ1 toward the twist angle θ2.

Thereafter, in this embodiment, substantially at the same time when the loosening member 6 reaches the second position, the contact portion 6*a* overcomes a top of the blade 5*a* and does not engage with the blade 5*a*. For that reason, the loosening member 6 is rotated in a stroke from the second position (FIG. 5(*c*)) to the first position (FIG. 5(*a*)) in the second direction B2 by the torsion moment torque accumulated in the urging portion 6*b*.

By repeating a swing operation (rotating operation) described above, the loosening member 6 loosens the toner accumulated on the second wall surface W2 and feeds the toner toward the feeding screw 5.

Here, in this embodiment, a constitution in which the torsion moment torque generates in an entirety of a range of the swing operation of the loosening member 6 is not employed, but a constitution in which the torsion moment torque generates from a midway of the swing operation was employed. By this, a necessary minimum torsion moment torque required for loosening the toner accumulated on the second wall surface W2 is generated, so that an operation noise generated by the swing operation can be reduced.

Particularly, in this embodiment, the urging portion 6 and the loosening portion 6*c* are formed by a single component part. For example, in the case of the belt cleaning device 1 used in the image forming apparatus 100 for forming an image with an A4-size width or more, the length of the loosening portion 6*c* with respect to the thrust direction is about 300 mm or more. For that reason, in order to sufficiently loosen the toner accumulated on the second wall surface W2 by the swing operation of the loosening member 6, it is desired that the loosening member 6 is constituted by a linear material with a sufficient wire diameter so as not to cause an improper operation due to flexure of the loosening portion 6*c*. However, with an increasing wire diameter of the linear material constituting the loosening member 6, the torsion moment torque generated by the loosening member 6 becomes large, so that the operation noise generated by the swing operation becomes large. For that reason, as in this embodiment, as a constitution in which the torsion moment torque generates from the midway of the swing operation, it is preferable that the operation noise generated by the swing operation is reduced.

As described above, in this embodiment, without separately providing an actuator for driving the loosening member 6, the toner accumulated on the second wall surface W2 can be sufficiently loosened and fed to the feeding screw 5. By this, without remarkably increasing a cost, with a constitution in which the operation noise is suppressed to the extent possible, the accumulation of the toner on the second wall surface W2 is alleviated, so that the toner can be satisfactorily fed to the outside of the belt cleaning device 1.

4. Arrangement of Contact Portion of Lossening Member

Figure 6:
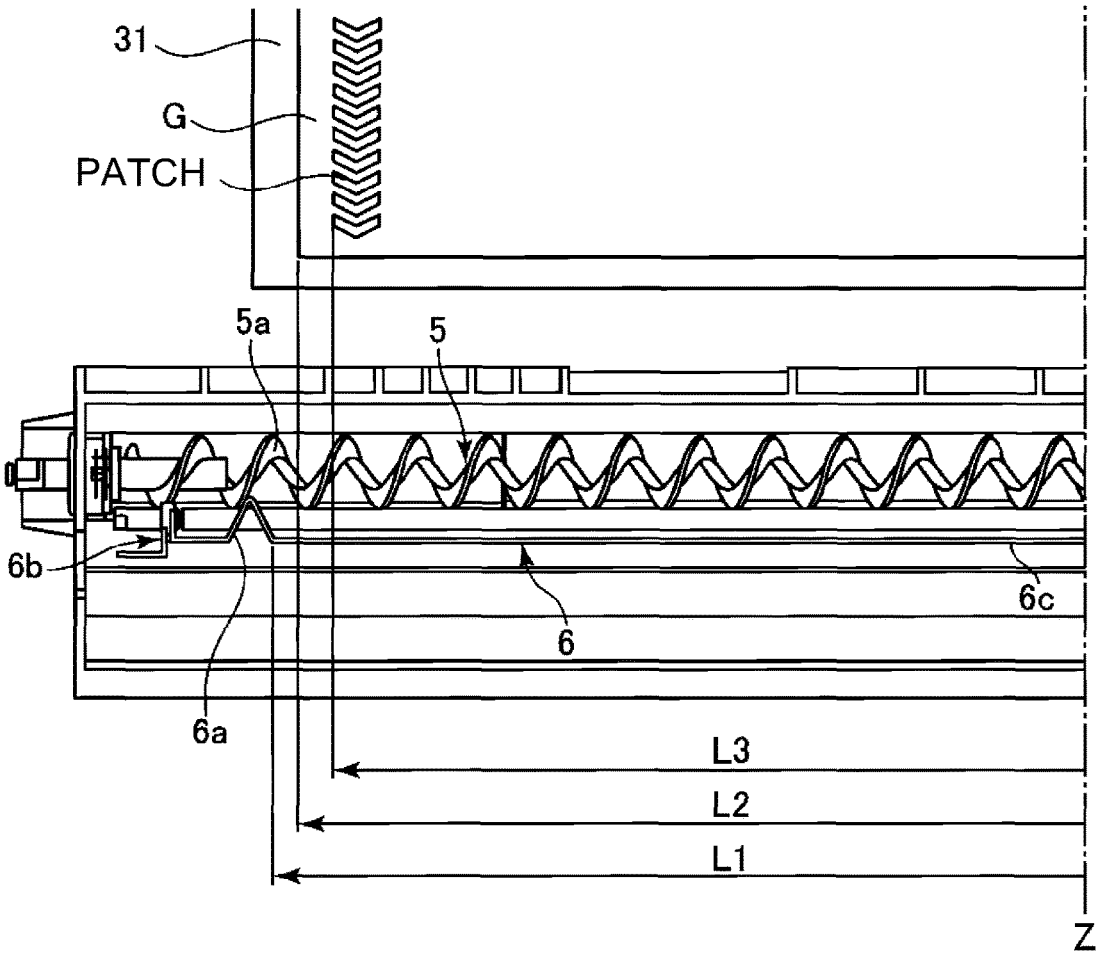
FIG. 6 is an illustration for illustrating an arrangement of a contact portion of the loosening member.

Next, with reference to FIG. 6, an arrangement of the contact portion 6*a* in the loosening member 6 will be described. FIG. 6 is an illustration for illustrating a relationship between an image forming region G on the intermediary transfer belt 31 with respect to the thrust direction and the arrangement of the contact portion 6*a*, and a chain line Z in the figure shows a center of the image forming region G with respect to the thrust direction.

As shown in FIG. 6, in this embodiment, the contact portion 6*a* is disposed at a position of a distance L1 from the center Z of the image forming region G toward an end portion side with respect to the thrust direction. That is, the contact portion 6*a* is provided further towards the end portion side of the loosening member 6 than the center of the loosening member 6 with respect to the rotation axis direction of the loosening member 6.

In this embodiment, the urging portion 6*b* of the loosening member 6 is provided at an end portion of the loosening member 6 with respect to the rotation axis direction of the loosening member 6. Further, the loosening portion 6*c* of the loosening member 6 is stretched along the rotational axis of the loosening member 6. If the contact portion 6*a* is disposed in the neighborhood of a central portion of the image forming region with respect to the thrust direction, i.e., is disposed in the neighborhood of a central portion of the loosening member 6 with respect to the rotation axis direction, it would be considered that the loosening portion 6*c* flexes and causes an improper operation. In order to suppress this, it would be considered that the wire diameter of the linear material constituting the loosening member 6 is made large, but in the case where the wire diameter is large, spring constant increases, and therefore, when a tolerance fluctuates, the operation noise becomes large in some cases. For that reason, the contact portion 6*a* may preferably be disposed at the end portion.

Further, in this embodiment, the loosening member 6 is formed with the linear spring which is a single component part. In this case, the position of the contact portion 6*a* with respect to the thrust direction is equivalent to non-existence of the loosening portion 6*c*. For that reason, the position of the contact portion 6*a* with respect to the thrust direction is a place where although an entirety of the loosening member 6 moves in the thrust direction correspondingly to play or deformation of the spring and a certain loosening effect is obtained, the loosening effect is small compared with the loosening portion 6*c*. Therefore, in this embodiment, the contact portion 6*a* is provided outside a region, in which the toner image on the intermediary transfer belt 31 is carried, with respect to the thrust direction. That is, when a distance from the center Z of the image forming region G to the end portion with respect to the thrust direction is L2, the contact portion 6*a* is disposed so as to satisfy L1>L2. By this, the toner hardly reaches the position of the contact portion 6*a* with respect to the thrust direction, and therefore, even when the loosening effect is small at the contact portion 6*a*, there is no problem.

Further, on the intermediary transfer belt 31, a toner image (test image) for adjustment is formed in some instances. For example, a patch detecting sensor constituted by an optical sensor is provided opposed to the intermediary transfer belt 31, and a position or a density, on the intermediary transfer belt 31, of the test image formed on the intermediary transfer belt 31 is detected by the patch detecting sensor. Then, on the basis of a detection result thereof, correction of an image writing position or a density change is carried out. This test image is formed depending on an instruction of an operator such as a user or with predetermined timing. The predetermined timing is appropriately set, for example, at the time of rise (actuation) of the image forming apparatus 100 or every number of times of output of a predetermined image, or the like. Then, this test image is not transferred onto the transfer material S, and almost all thereof is fed to the cleaning portion where the intermediary transfer belt 31 is cleaned by the belt cleaning device 1. For that reason, at a place of the belt cleaning device 1 corresponding to a position where this test image is formed, compared with other places, the toner accumulates in a large amount. Further, consequently, on the second wall surface W2 corresponding to the position where the test image is formed, the amount of deposited toner is larger than that at other places. Therefore, the contact portion 6*a* may preferably be provided at least on a side closer to the end portion of the loosening member 6 than the position where the toner image for adjustment is formed on the intermediary transfer belt 31 is with respect to the thrust direction. That is, when distance from the center Z of the image forming region G to the end portion of the region in which the test image is formed with respect to the thrust direction is L3, the contact portion 6*a* may preferably be disposed so as to satisfy L1>L3. By this, the toner of an amount larger than those at other positions does not come at the position of the contact portion 6*a* with respect to the thrust direction, and therefore, even when the loosening effect is small at the position of the contact portion 6*a*, there is no problem.

Incidentally, in this embodiment, L1=165 mm, L2=162 mm, and L3=150 mm.

5. Relationship Between Feeding Screw and Contact Portion of Loosening Member

As shown in FIG. 4, in this embodiment, the feeding screw 5 is held only at a holding portion 5*b* provided at one end portion with respect to the rotation axis direction thereof, and the other end portion is a free end portion 5*c*. That is, in this embodiment, the feeding screw 5 is held only at the end portion, on one side, of the both end portions with respect to the rotation axis direction thereof. In this case, the contact portion 6*a* may preferably be provided on one end portion side, where the holding portion 5*b* is provided, than at the central portion of the feeding screw 5 with respect to the rotation axis direction of the feeding screw 5. This is because it is considered that when the contact portion 6*a* is provided on the free end portion 5*c* side, the feeding screw 5 flexes and gets away from the contact portion 6*a* and a desired swing operation of the loosening member 6 cannot be performed.

Figure 7:
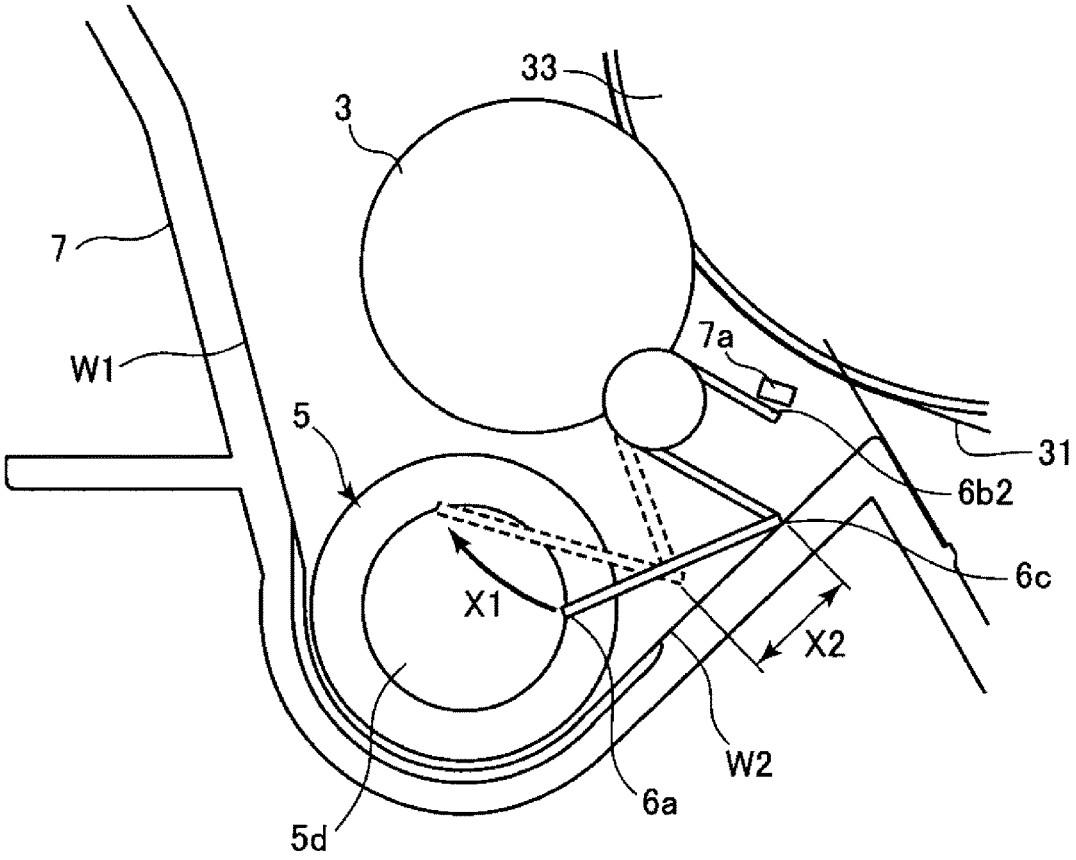
FIG. 7 is an illustration for illustrating a relationship between the loosening member and a shaft member of the feeding screw.

Further, the feeding screw 5 may preferably be not provided with a shaft member at least inside the blade 5*a* contacting the contact portion 6*a* with respect to a radial direction. FIG. 7 is a sectional view for illustrating that a swingable region of the loosening member 5 is different between the case where the shaft member is present at the center portion of the feeding screw 5 and the case where the shaft member is absent at the center portion of the feeding screw 5. As shown in FIG. 7, in the case where a shaft member 5*d* is present at the center portion of the feeding screw 5, the contact portion 6*a* and the shaft member 5*d* interfere with each other, and therefore, the swingable region of the loosening member 6 relatively becomes small. On the other hand, in the case where the shaft member 5*d* is absent at the center portion of the feeding screw 5, the contact portion 6*a* and the shaft member 5*d* do not interfere with each other, and therefore, the contact portion 6*a* can be swung toward the feeding screw 5 side deeper than the case where the shaft member 5*d* is present by an amount corresponding to X1 of FIG. 7. By this, the toner accumulated on the second wall surface W2 can be loosened in a large amount corresponding to a range of X2 of FIG. 7. For that reason, at least at a position corresponding to the blade 5*a* contacting the contact portion 6*a*, it is preferable that the shaft member 5*d* is absent at the center portion of the feeding screw 5. In this embodiment, the feeding screw 5 is constituted by a shaft-free screw in which the shaft member does not pass through a central portion of the blade 5*a* at a most portion excluding a predetermined range in the neighborhood of the holding portion 5*b*.

As described above, according to this embodiment, with a simple constitution, the accumulation of the toner on the wall surface can be efficiently alleviated.

[Others]

In the above, the present invention was described in accordance with the specific embodiment, but the present invention is not limited to the above-described embodiment.

In the above-described embodiment, the present invention was applied to the belt cleaning device for cleaning the intermediary transfer belt, but the present invention is not limited thereto. For example, the present invention is applicable when the cleaning device is a cleaning device for cleaning the image bearing member for bearing the toner image, such as a cleaning device for cleaning the photosensitive drum. The image bearing member may also be an electrostatic recording di electric member.

Further, in this embodiment, the loosening member was constituted by the single component part which is the linear spring, but the present invention is not limited thereto. For example, the loosening member may also be constituted by two component parts including the torsion coil spring shape portion formed of the spring material corresponding to the urging portion in the above-described embodiment and the loosening portion formed of the resin member corresponding to the loosening portion in the above-described embodiment. However, according to the constitution of the above-described embodiment, the number of component parts is reduced, so that the cost can be suppressed.

INDUSTRIAL APPLICABILITY

According to the present invention, there is provided a cleaning device and an image forming apparatus which are capable of efficiently alleviating the accumulation of the toner on the wall surface.

The invention claimed is:

1. A cleaning device comprising:

a cleaning member, contacting an image bearing member for bearing a toner image, for removing toner from the image bearing member with movement of the image bearing member;

a container for temporarily accommodating the toner removed from the image bearing member by said cleaning member;

a feeding screw, including a helical blade, for feeding the toner inside said container to outside of said container; and a loosening member, constituted by a member including a linear spring and provided in a neighborhood of said feeding screw and a wall surface of said container, for loosening the toner on the wall surface of said container, wherein said loosening member includes a torsion coil spring portion, a loosening portion, a contact portion and a portion-to-be-limited, wherein said torsion coil spring portion is formed by winding said loosening member about a shaft member provided on one end side of said container and having a rotational axis substantially parallel to a rotational axis direction of said feeding screw, and wherein at one arm portion connecting to said torsion coil spring portion, said portion-to-be-limited is provided, and at the other arm portion connecting to said torsion coil spring portion, said contact portion and said loosening portion are provided, wherein said loosening portion is provided so as to extend in the rotational axis direction and loosens the toner on the wall surface by being rotated about the rotational axis bi-directionally in a direction crossing the rotational axis, wherein said contact portion is provided between said loosening portion and said torsion coil spring portion with respect to the rotational axis direction and contacts a blade of said feeding screw, and rotates said loosening portion in a first direction around the rotational axis by being rotated in the first direction with rotation of said feeding screw, and wherein said portion-to-be-limited is provided further towards an end portion side of said loosening member than said torsion coil spring portion is and is limited in rotation thereof together with said contact portion in contact with a limiting portion provided inside said container, and wherein a restoring force for rotating said loosening portion in a second direction opposite to the first direction is accumulated in said torsion coil spring portion by limiting said portion-to-be-limited by said limiting portion when said contact portion is rotated in the first direction with rotation of said feeding screw, and when said contact portion overcomes said blade with subsequent rotation of said feeding screw, said loosening portion is rotated in the second direction by the accumulated restoring force.

2. A cleaning device according to claim 1, wherein said portion-to-be-limited does not contact said limiting portion before said loosening portion reaches a third position during rotation of said loosening portion from a first position closest to the rotational axis toward a second position furthest from the rotational axis, and contacts said portion-to-be-limited when said loosening portion reaches the third position, and when said loosening portion is substantially rotated from the third position toward the second position, the restoring force is accumulated in said torsion coil spring portion.

3. A cleaning device according to claim 2, wherein when said loosening portion reaches the second position, said contact portion overcomes said blade and said loosening member is rotated in the second direction by the restoring force accumulated in said torsion coil spring portion.

4. A cleaning device according to claim 1, wherein said feeding screw is not provided with said shaft member at least inside said blade contacting said contact portion with respect to a radial direction of said blade.

5. A cleaning device according to claim 1, wherein of first and second wall surfaces provided around said feeding screw on both sides of a vertical surface passing through the rotational axis, said first wall surface has a wall surface angle larger than an angle of repose of the toner in said container and said second wall surface has a wall surface angle smaller than the first wall surface angle, and said loosening member loosens the toner on said second wall surface, the angle of repose being an angle with respect to a horizontal surface.

6. A cleaning device according to claim 5, wherein the wall surface angle of said second wall surface is smaller than the angle of repose of the toner in said container.

7. A cleaning device according to claim 5, wherein the toner removed from the image bearing member by said cleaning member drops onto said second wall surface.

8. A cleaning device according to claim 5, comprising a plurality of cleaning members, wherein the toner removed from the image bearing member by at least one cleaning member of said plurality of cleaning members drops onto said second wall surface.

9. An image forming apparatus comprising:

an image bearing member for bearing a toner image;

a cleaning member, contacting said image bearing member, for removing toner from said image bearing member with movement of said image bearing member;

a container for temporarily accommodating the toner removed from said image bearing member by said cleaning member;

a feeding screw, including a helical blade, for feeding the toner inside said container to outside of said container; and a loosening member, constituted by a member including a linear spring and provided in a neighborhood of said feeding screw and a wall surface of said container, for loosening the toner on the wall surface of said container, wherein said loosening member includes a torsion coil spring portion, a loosening portion, a contact portion and a portion-to-be-limited, wherein said torsion coil spring portion is formed by winding said loosening member about a shaft member provided on one end side of said container and having a rotational axis substantially parallel to a rotational axis direction of said feeding screw, and wherein at one arm portion connecting to said torsion coil spring portion, said portion-to-be-limited is provided, and at the other arm portion connecting to said torsion coil spring portion, said contact portion and said loosening portion are provided, wherein said loosening portion is provided so as to extend in the rotational axis direction and loosens the toner on the wall surface by being rotated about the rotational axis bi-directionally in a direction crossing the rotational axis, wherein said contact portion is provided between said loosening portion and said torsion coil spring portion with respect to the rotational axis direction and contacts a blade of said feeding screw, and rotates said loosening portion in a first direction around the rotational axis by being rotated in the first direction with rotation of said feeding screw, and wherein said portion-to-be-limited is provided further towards an end portion side of said loosening member than said torsion coil spring portion is and is limited in rotation thereof together with said contact portion in contact with a limiting portion provided inside said container, and wherein a restoring force for rotating said loosening portion in a second direction opposite to the first direction is accumulated in said torsion coil spring portion by limiting said portion-to-be-limited by said limiting portion when said contact portion is rotated in the first direction with rotation of said feeding screw, and when said contact portion overcomes said blade with subsequent rotation of said feeding screw, said loosening portion is rotated in the second direction by the accumulated restoring force.

10. An image forming apparatus according to claim 9, wherein said contact portion is provided outside of a region, with respect to the rotation axis direction, where said image bearing member bears the toner image.

11. An image forming apparatus according to claim 9, wherein said contact portion is provided further towards an end portion side of said loosening member than a position, with respect to the rotation axis direction, where said image bearing member bears the toner image.

* * * * *